United States Patent [19]

Person

[11] Patent Number: 4,941,435

[45] Date of Patent: Jul. 17, 1990

[54] METHOD AND APPARATUS FOR PREVENTING LOW-WATER FAILURE IN BOILERS

[76] Inventor: Thomas C. Person, 3205 Natural Bridge, St. Louis, Mo. 63107

[21] Appl. No.: 370,984

[22] Filed: Jun. 23, 1989

[51] Int. Cl.[5] ..... F22B 37/54

[52] U.S. Cl. ..... 122/382; 122/447; 219/333

[58] Field of Search ..... 122/448 R, 448 A, 447, 122/382; 126/351; 219/333

[56] References Cited

U.S. PATENT DOCUMENTS

| | | | |
|---|---|---|---|
| 1,957,825 | 5/1934 | Flagg | 122/447 |
| 2,967,021 | 1/1961 | Swenson et al. | 122/447 |
| 4,723,066 | 2/1988 | Kurukawa et al. | 219/333 X |

*Primary Examiner*—William E. Wayner
*Attorney, Agent, or Firm*—Veo Peoples, Jr.

[57] ABSTRACT

An improved system for preventing low-water or "dry-boiler" failures which includes automatically flushing the low-water cut-off control valve and monitoring the external temperature of the boiler jacket so as to shut off the burners of the boiler, when such external temperature exceeds a pre-determined maximum, is disclosed.

2 Claims, 3 Drawing Sheets

METHOD AND APPARATUS FOR PREVENTING LOW-WATER FAILURE IN BOILERS

BACKGROUND OF THE INVENTION

1. The Field of the Invention

This invention relates to control methods and apparatus for use in steam boilers to prevent activation of the water heating elements in unsafe conditions.

2. Description of the Prior Art

Most steam boilers include a reservoir, in which the water is heated by the burner and a safety control system having a float mechanism for deactivating, or preventing activation of the burner, in the event the water level drops below a pre-determined danger, or cut-off point. The float is normally connected to the control system, by a pivotable linkage surrounded by an accordian-type protective sleeve, or bellows.

During extended periods of operation "mud" or "sludge" and other residue from the reservoir water accumulate in the float chamber and can prevent movement of the float, in response to changes in the water level. The mud can also accumulate on the bellows and prevent movement of the linkage. Furthermore, although the linkage itself is insulated from the mudd, it may become "frozen" by corrosion at the pivot points from the seepage of sediment through the bellows which would prevent the float from moving in response to changes in the water level. In any of these situations, the float may become stuck in an upper position above the water level, and, thus provide, no indication when the water level reaches the predetermined cut-off level, and therefore, not deactivate or prevent activation of the burner. This invariably results in all the water being boiled off and destructive failure, if not explosion of the furnace from the unsafe overheated condition.

Normal maintenance of these water-boiling furnaces requires that the blow-down valve lying underneath the low water shut-off valve be opened manually, on a regular basis in order to "flush" the mud, sludge or other sediment which accumulates in the float chamber. However, it has been well established that the control systems are infrequently "flushed" and thus, dry-boiler failures are not uncommon.

In the past, attempts to remedy this problem have been undertaken in one of two different ways.

First of all, attempts have been made to redesign the low water cut-off valve. However, such attempts have met with very little, if any commercial success, because of the expense of redesigning such valves, their cumbersom nature, and or their technical failure. One example of such an attempt was disclosed in U.S. Pat. No. 3,776,200. Therein, the traditional low-water shut-off valve is redesigned to accommodate a small motor with a cam which automatically pushes down the float to its lowest position just prior to each firing cycle of the boiler. If the float is either defective or so sticky that it does not return to its original position an alarm sounds and the boiler is prevented from firing. However, if the float releases to its original position the firing cycle goes forward, however, such a system has several drawbacks. That is the system does not alleviate the need for manually flushing the float chamber. It merely provides an indication of when maintenance is needed. Also, if, for some reason, there is not sufficient accumulation of sediment to restrict the float during the initial checking stage, but sufficient sediment accumulates during the firing cycle to cause the float to stick, the water level might still fall below the danger point and result in dry boiler failure. Additionally, the insulation of this system requires dismantling of currently employed low water shut-off valves and replacing them with the newly designed valve and the expense of such valves is so exorbitant that it is not commercially feasible in many places where boilers are already installed nor is it a commercially attractive alternative to the more simple low water shut-off valve, given the fact that maintenance is still required to prevent low water failure.

The second alternative approach to preventing low water or dry boiler failure is that of incorporating an internal water level probe into the interior jacket of the boiler reservoir. This probe is purportedly designed to detect water and upon water falling below the level of the probe, the circuit is broken and the burner of the boiler is deactivated. However, a primary drawback to this system, is that sediment, dirt, or mudd from the water often is stuck in the probe but remains moist enough to provide a false signal that the water level has not receded below the level of the probe. Accordingly, the burners of the boiler may continue to fire even though the water level has dropped below the probe and dry boiler failure occurs. Such systems are disclosed in, for example, U.S. Pat. No. 3834357. An additional drawback to such a system, is that although it provides a secondary backup for proportedly shutting down the boiler at low water points, these systems do not serve as a substitute for maintaining the low water control valve by way of manually flushing it.

Accordingly, there would be a substantial advancement and a satisfaction of a long-felt need in the industry to provide an inexpensive system for preventing dry-boiler failure which would eliminate the need for manually blowing down, which could be inexpensively and readily adapted to, and/or installed upon currently existing low water shut-off valves, and which has a back-up shut down of the boiler triggered upon overheating of the boiler reservoir rather than based upon a faulty water level monitoring probe.

SUMMARY OF THE INVENTION

It is an object of the present invention to provide a new and improved method for preventing low water failure in water boilers without redesigning or replacing the conventional low water shut-off valve.

It is another principle object of the present invention to provide a new and improved method for preventing low water failure in water boilers with a fail-safe back-up to the low water shut-off valve which prevents the burners from firing whenever the water level within the boiler reservoir falls below the danger level, negating the need to monitor the water level itself within the boiler.

It is a still further object of the present invention to provide a new and improved method for continually maintaining serviceability of a low water shut-off valve on a water boiler without having to manually blowdown the low water shut-off valve.

It is a further principle object of the present invention to provide a new and improved apparatus for preventing low water failure of water boilers which can be readily and economically installed on existing low water shut-off systems. These objects and others which will become more apparent from the following detailed description and claims, are fulfilled by a microprocessor boiler protection control unit which electronically opens and closes a blowdown valve for brief periods during the waterfeed cycle of water boiler systems, and which is programmed to automatically deactivate the burner elements of the boiler whenever the external temperature of the boiler reservoir exceeds a predetermined danger point.

DETAILED DESCRIPTION OF THE PREFERRED EMBODIMENTS

Figure 1:
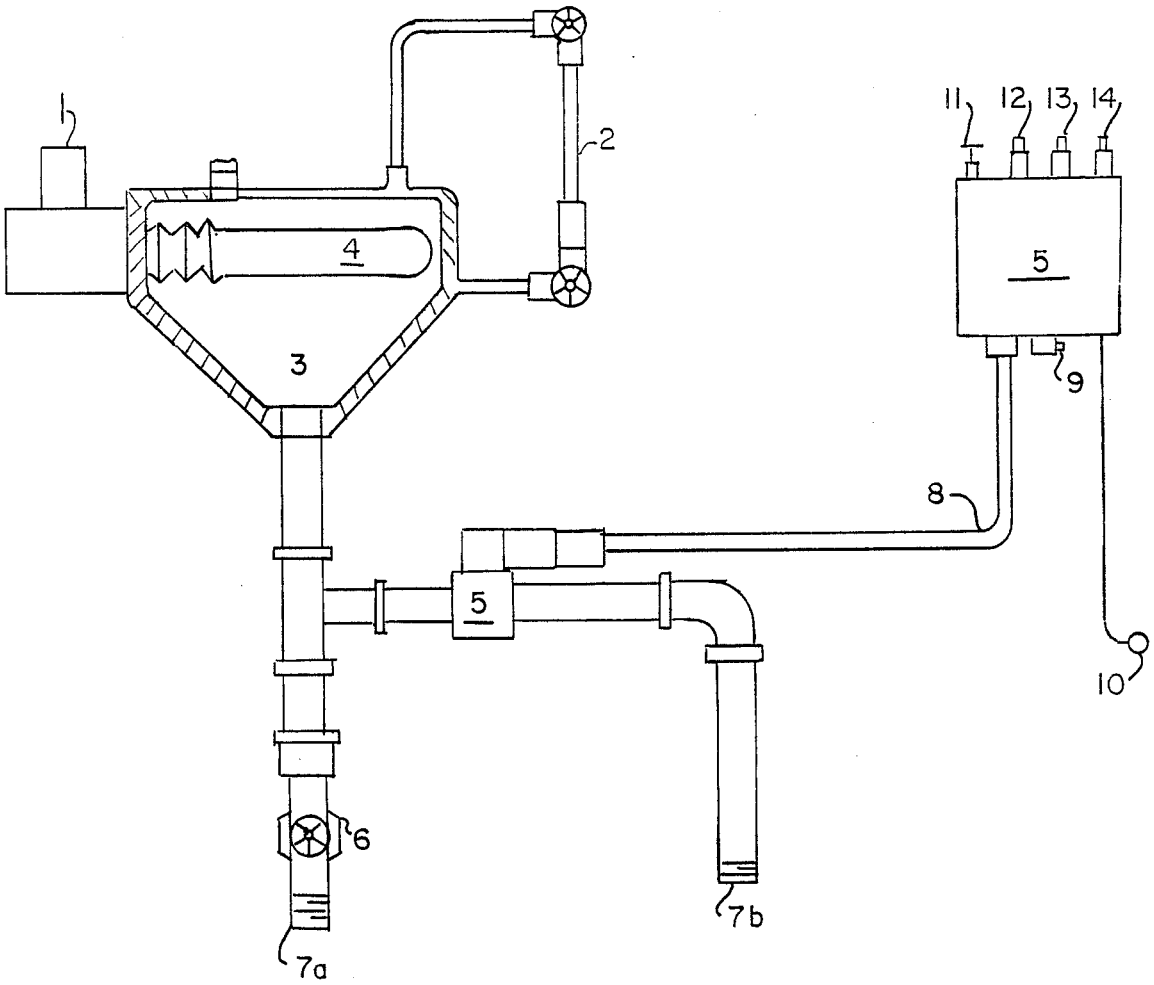
FIG. 1 is a front, vertical view, of the low water control system of a water boiler, including a cross-sectional view of the low water shut-off valve reservoir illustrating the float in an upper position, and including the microprocessor boiler protection device assembled and installed on the system.

Referring now to the drawings, there is shown at FIG. 1 an electrical connection (1) which delivers an electrical signal deactivating the boiler burner elements whenever the float (4) is at its lowest point or alternatively activating the burners as the water level within the low water shut-off valve reservoir (3) rises sufficiently to raise the float (4). A site glass (2) is shown with a line indicating that water level of the boiler reservoir and the low water shut-off valve reservoir (3) are up and which in turn, illustrates the proper operation of the float (4) at its upper position. If the low water control valve were inoperable, the low water control valve reservoir (3) would contain accumulated sludge or mud which would result in the float (4) remaining in its upper position even though the water level as seen in the site glass (2) would be substantially below the level of the float (4). An electronically activated blowdown valve (5), preferably, for example, a solenoid valve is shown to cooperate through an electrical connection (8) directly into the microprocessor (15) which signals the valve (5) to open or blowdown for a brief period of for example between one second, and about 20 seconds, preferably about five seconds, whenever the water feed cycle to the boiler commences, either through an automatic water feeder, or by manually feeding water.

A temperature detection component or sensor (10), preferably a thermistor, is shown which is connected directly to the external jacket of the water boiler reservoir and signals the microprocessor (15) to deactivate the boiler burner elements whenever the temperature of the external jacket exceeds a pre-determined danger point. This pre-determined danger point may be for example as low as 212 F. for low pressure boilers. There is an electrical connection (9) for 115 voltage power source and wiring connected to the low water shut-off valve. A manual blowdown valve (6), is shown to allow manual blowdown, if desired. It may be that this valve (6) must be relocated from it's normal position which is somewhat higher along the drainline (7*a*). The secondary drainline (7*b*) shows the escape of the automatically blowndown sediment and mud from valve (5). There is a high temperature reset button (11) to restart the system, in the event of automatic deactivation of the burners. There is a LED light (12) to indicate the system is operating normally. Preferably, this is a different color from the other indicator lights. It is particularly preferred to use a green light or indicator cap, at this position.

An additional LED light (13) is provided to indicate the activation of the blowdown cycle. Preferably, this is yellow in color. There is also provided, an additional LED light (14) to indicate the system has overheated, and that the burner elements have been shut-down. Preferably, this is red in color.

Figure 3:
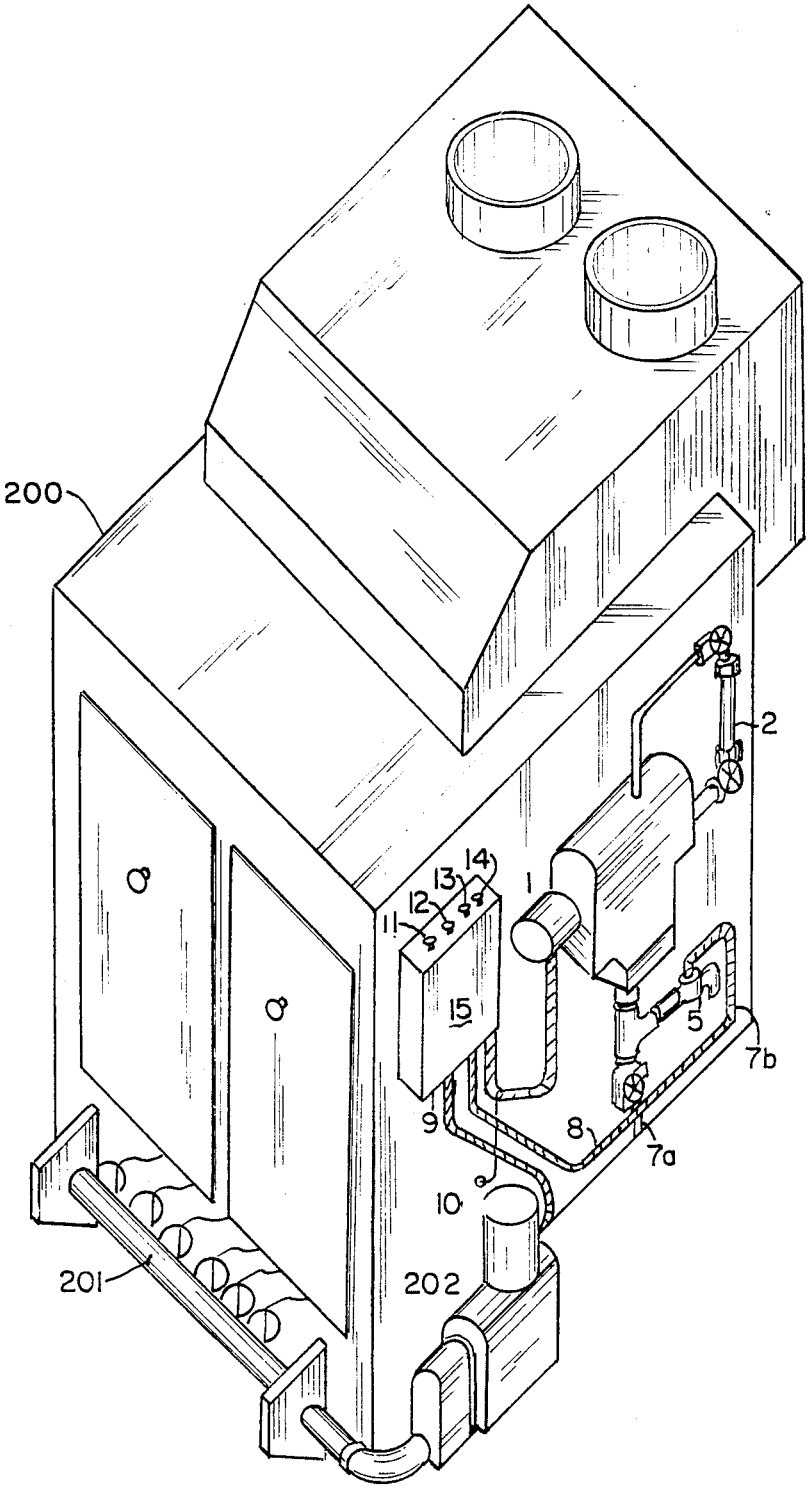
FIG. 3 is a perspective view of a boiler having the microprocessor, boiler protection device of the present invention affixed to the exterior jacket of the boiler.

Referring to FIG. 3, a conventional boiler (200) is shown, together with its burner assembly (201) and the device of the present invention as shown in FIG. 1 is affixed to the external jacket (202) of the boiler.

Circuit Description

Figure 2:
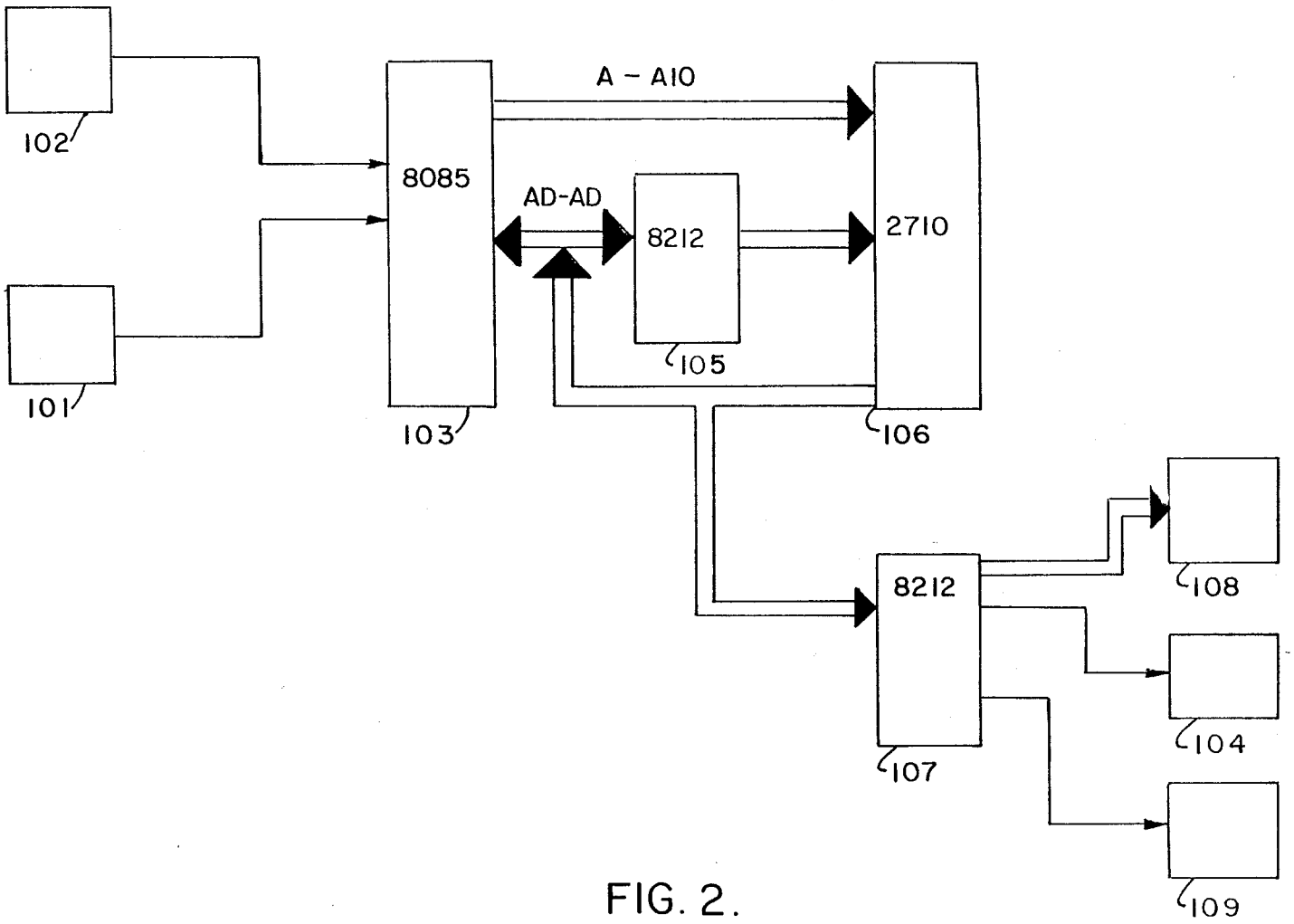
FIG. 2 is a diagrammatic presentation of the electrical means employed in the microprocessor boiler protection control device.

Referring to FIG. 2, the relay (101) operates to open and close the circuit for the power lines which control the water feed cycle to the boiler tank or reservoir and is connected to a terminal block located inside the microprocessor control compartment (15) of FIG. 1. The thermistor circuit (102) consists of a thermister attached to the external jacket of the boiler tank or reservoir and may be obtained from any of a variety of different commercial sources. Preferably, the thermister is an electronic sensor for low pressure boilers which will activate at temperatures above for example 250 F. sending an electrical signal through the microprocessor (103) which signals the relay (101) for automatic water feeds which will close the circuit and begin the water feeding cycle into the tank. Simultaneously, signals are converted from the microprocessor (103) to the relay (104) which opens a circuit and interrupts the power to the burner or heater elements of the water boiler. An electronic latch (105) is connected between the Eprom (106) and microprocessor (103) and serves to distinguish between addresses and data on the address/data bus. The eprom (106) consist of an erasable programmable "read only memory" used to store the computer program for the unit. This component is connected so as to receive electronic signals then transmit signals in a variety of different ways. The output port (107) controls the LED output to the LEDs (12), (13), (14) of FIG. 1 through the LED circuit (108) of FIG. 2. Additionally, the output port (108) controls the relays (104) and (109). The relay (109) opens and closes the circuit for the blow down valve and FIG. 1 which valve (105) is preferably a solenoid.

OPERATIONS

The device of the present invention automatically blows down the sediment of the muddy or sludge-filled water through valve (5) of FIG. 1 by activation of relay (9) of FIG. 2 each time water is added to the boiler by activation of relay (1) of FIG. 2. This allows all of the accumulating rust and dirt which forms the sediment to be blown down out of the system prior to an over-accumulation occurring which in the past would disrupt operation of the low water cut-off valve float (4) of FIG. 1. The device also has a fail-safe feature employed to shut off the boiler if it overheats beyond a predetermined temperature. If, for example, the float (4) of FIG. 1 should become stuck or inoperable for either a mechanical reason or for example in the event the blow down valve (5) of FIG. 1 fails to operate properly, the device is designed to shut off the burner (201) through relay (4). The boiler can then be turned on only if the unit is reset. Accordingly, the boiler is self maintained, and can be monitored on or off-site, and emergency service can be provided to steam boilers before serious damage occurs without having to constantly observe and/or manually blow down the unit.

INSTALLATION

Installation of this simple unit is achieved by (A) mounting the microprocessor (15) on the side (202) of the boiler (200) (B) drilling a whole in the casing of the reservoir for the installation of the thermistor (10), (C) adding a flange adaptor on the bottom of the brew water shut-off, (D) relocating the manual blown down valve (6) to the position shown in FIG. #1 including the installation of a tee fitting, which allows the installation of a solenoid valve (5) of FIG. #1 that allows automatic blow down of the low water shut off control.

What is claimed is:

1. An improved method for preventing low-water failure in boilers comprising:

(a.) periodic blow down of feed water from the bottom of a low-water cut-off control valve during the water feed cycle for from one second to the entire period of the feed cycle;

(b.) shutting off the blow down after an effective period of time;

(c.) monitoring the temperature of the boiler jacket by an external temperature sensor; and (d.) automatically shutting off the burners of the boiler when the sensor senses any temperature above a predetermined danger point.

2. A microprocessor boiler protection device comprising (a) A low-water cut-off valve having its drain pipe pass through an electronically activated blow down valve integrally connected to a microprocessor which signals the blow down valve to open for a brief period whenever the water feed cycle of the boiler commences, and (b) an electronic temperature detection component affixed to the external jacket of the boiler reservoir which deactivates the burners of the boiler when the temperature detection component senses a temperature higher than a predetermined danger point.

* * * * *